US010930211B2

(12) United States Patent
Koh et al.

(10) Patent No.: US 10,930,211 B2
(45) Date of Patent: Feb. 23, 2021

(54) LUMINANCE CONTROL CIRCUIT AND DISPLAY DEVICE HAVING THE SAME

(71) Applicant: SAMSUNG DISPLAY CO., LTD., Yongin-si (KR)

(72) Inventors: Jai-hyun Koh, Yongin-si (KR); Jaehoon Lee, Seoul (KR); Heendol Kim, Yongin-si (KR); Kuk-hwan Ahn, Hwaseong-si (KR); Soo-yeon Lee, Hwaseong-si (KR); Moonshik Kang, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/235,374

(22) Filed: Dec. 28, 2018

(65) Prior Publication Data

US 2019/0213953 A1 Jul. 11, 2019

(30) Foreign Application Priority Data

Jan. 5, 2018 (KR) ..... 10-2018-0001883

(51) Int. Cl.
*G09G 3/3233* (2016.01)
*G09G 3/36* (2006.01)
(Continued)

(52) U.S. Cl.
CPC ..... *G09G 3/3233* (2013.01); *G09G 3/3225* (2013.01); *G09G 3/3406* (2013.01);
(Continued)

(58) Field of Classification Search
CPC ..... G09G 3/2007; G09G 3/2077; G09G 3/32; G09G 3/3225–3258; G09G 3/3275–3291; G09G 3/3406–3426; G09G 3/3607; G09G 3/3648; G09G 3/3685–3696; G09G 5/02; G09G 5/026; G09G 5/10; G09G 2310/0243; G09G 2310/0289; G09G 2320/0233; G09G 2320/0242; G09G 2320/0257;
(Continued)

(56) References Cited

U.S. PATENT DOCUMENTS 8,378,936 B2 2/2013 Koh et al.
8,427,513 B2 4/2013 Shidara et al.
(Continued)

FOREIGN PATENT DOCUMENTS

KR 10-0629587 9/2006
KR 1020080101700 11/2008
(Continued)

*Primary Examiner* — Nathan Danielsen
(74) *Attorney, Agent, or Firm* — F.Chau & Associates

(57) ABSTRACT

A luminance control circuit of a display device includes a target luminance gain calculator calculating a target luminance gain based on an average luminance of a first image signal when the first image signal is determined to be a still image, an output luminance gain calculator calculating an output luminance gain based on a previous output luminance gain of a previous frame and the target luminance gain of a present frame, and a luminance scaler outputting a second image signal obtained by changing a luminance of the first image signal based on the output luminance gain.

16 Claims, 8 Drawing Sheets

(51) Int. Cl.
*G09G 3/34* (2006.01)
*G09G 3/3225* (2016.01)

(52) U.S. Cl.
CPC ... *G09G 3/3648* (2013.01); *G09G 2320/0276* (2013.01); *G09G 2320/046* (2013.01); *G09G 2320/0626* (2013.01); *G09G 2320/0653* (2013.01); *G09G 2320/103* (2013.01); *G09G 2360/16* (2013.01)

(58) Field of Classification Search
CPC ... G09G 2320/0271; G09G 2320/0276; G09G 2320/043–048; G09G 2320/0626–0653; G09G 2320/103; G09G 2360/16
See application file for complete search history.

(56) References Cited

U.S. PATENT DOCUMENTS

2003/0025718 A1* 2/2003 Mori ..... G09G 5/10 345/690
2010/0060554 A1* 3/2010 Koh ..... G09G 3/3225 345/77
2013/0120468 A1* 5/2013 Hsieh ..... G09G 3/2003 345/690
2013/0222414 A1* 8/2013 Ito ..... G09G 5/02 345/600
2014/0160173 A1* 6/2014 Lee ..... G09G 3/3225 345/690
2017/0004753 A1 1/2017 Kim et al.

FOREIGN PATENT DOCUMENTS

KR 10-2013-0018493 2/2013
KR 10-1467496 11/2014
KR 10-1470644 12/2014
KR 10-1534627 7/2015
KR 10-1588449 1/2016
KR 10-2016-0056488 5/2016
KR 10-2016-0078535 7/2016
KR 10-2017-0005329 1/2017

* cited by examiner

LUMINANCE CONTROL CIRCUIT AND DISPLAY DEVICE HAVING THE SAME

CROSS-REFERENCE TO RELATED APPLICATION

This U.S. non-provisional patent application claims priority under 35 U.S.C. § 119 to Korean Patent Application No. 10-2018-0001883, filed on Jan. 5, 2018, the contents of which are hereby incorporated by reference in its entirety.

TECHNICAL FIELD

The present disclosure relates to display devices capable of controlling a luminance of a display image.

DISCUSSION OF THE RELATED ART

An organic light emitting diode display (OLED) device is a self-emissive flat panel display device. An OLED device may have advantages of wide viewing angle and superior contrast ratio when compared with a liquid crystal display device. In addition, the OLED device may have advantages of thin thickness, light weight, and low power consumption.

In a case that the OLED device displays a specific pattern, i.e., a still image without motion (a freeze image), for a long time, the still image acts as a stress pattern, and as a result, an organic light emitting diode or a thin film transistor is easily deteriorated. The deterioration of the organic light emitting diode or the thin film transistor causes a stain like a DC afterimage and reduces a display quality and a lifespan of the OLED device.

SUMMARY

According to an aspect of the embodiments of the present invention, there is provided a luminance control circuit including a target luminance gain calculator calculating a target luminance gain based on an average luminance of a first image signal when the first image signal is determined to be a still image, an output luminance gain calculator calculating an output luminance gain based on a previous output luminance gain of a previous frame and the target luminance gain of a present frame, and a luminance scaler outputting a second image signal obtained by changing a luminance of the first image signal based on the output luminance gain.

The target luminance gain calculator outputs the target luminance gain that lineally depends upon the average luminance.

The target luminance gain (TLG) is obtained based on equation TLG=MRR+(1−APL)×MRR. The "APL" denotes the average luminance and the "MRR" denotes a luminance reduction coefficient. The "MRR" and the "APL" satisfy respectively the relations of MRR≤1 and APL≤1.

The luminance control circuit further includes a still image determination unit determining whether the first image signal is the still image and outputting a still image flag signal.

The luminance control circuit further includes an average luminance calculator calculating the average luminance of the first image signal when the still image flag signal is transited to a second level from a first level and maintains the target luminance gain while the still image flag signal is maintained at the second level.

The luminance control circuit further includes a luminance gain storage unit to store the previous output luminance gain.

The output luminance gain (OLG) is obtained based on equation OLG=decay weight (DW)×TLG−(1−DW)×PLG, and the decay weight (DW) is obtained based on equation DW=|PLG−TLG|×DR+DB. The "PLG" denotes the previous output luminance gain, the "TLG" denotes the target luminance gain, the "DR" denotes a decay rate, and the "DB" denotes a decay bias. The "PLG", the "TLG", the "DR", and the "DB" satisfy respectively relations of PLG≤1, TLG≤1, DR<1, and DB<1.

The second image signal (RGB2) is obtained based on equation RGB2=RGB1×OLG. The "RGB1" denotes the first image signal.

The target luminance gain calculator calculates the target luminance gain based on the average luminance of the first image signal when the first image signal is determined to be the still image.

According to an aspect of the embodiments of the present invention, there is provided a display device including a display panel including a plurality of pixels and a driving circuit receiving an input image signal, providing a data signal corresponding to an output image signal to the pixels, and controlling the pixels to display an image. The driving circuit includes an image signal processing circuit converting the input image signal to the output image signal. The image signal processing circuit includes a gamma converter converting the input image signal to a first image signal, a target luminance gain calculator calculating a target luminance gain based on an average luminance of the first image signal when the first image signal is determined to be a still image, an output luminance gain calculator calculating an output luminance gain based on a previous output luminance gain of a previous frame and the target luminance gain of a present frame, a luminance scaler outputting a second image signal obtained by changing a luminance of the first image signal based on the output luminance gain, and a gamma inverse converter converting the second image signal to the output image signal.

The target luminance gain calculator outputs the target luminance gain in proportion to the average luminance such that a luminance of the second image signal is lower than the luminance of the first image signal when the first image signal is determined to be a still image.

The target luminance gain (TLG) is obtained based on equation TLG=MRR+(1−APL)×MRR. The "APL" denotes the average luminance and the "MRR" denotes a luminance reduction coefficient. The "MRR" and the "APL" satisfy respectively the relations of MRR≤1 and APL≤1.

The display device further includes a still image determination unit determining whether the first image signal is the still image and outputting a still image flag signal.

The display device further includes an average luminance calculator calculating the average luminance of the first image signal. The target luminance gain calculator calculates the target luminance gain based on the average luminance when the still image flag signal has a first level.

The display device further includes a luminance gain storage unit to store the previous output luminance gain.

The second image signal (RGB2) is obtained based on equation RGB2=RGB1×OLG. The "RGB1" denotes the first image signal, and the "OLG" denotes the output luminance gain.

According to an aspect of the embodiments of the present invention, there is provided a display device including a display panel including a plurality of pixels, a backlight unit supplying a light to the display panel in response to a backlight control signal, and a driving circuit receiving an input image signal, providing a data signal corresponding to an output image signal to the pixels to display an image through the pixels, and outputting the backlight control signal in response to the input image signal. The driving circuit includes a backlight control circuit outputting the backlight control signal to control the light output from the backlight unit. The backlight control circuit includes a gamma converter converting the input image signal to a first image signal, a target luminance gain calculator calculating a target luminance gain based on an average luminance of the first image signal when the first image signal is determined to be a still image, an output luminance gain calculator calculating an output luminance gain based on a previous output luminance gain of a previous frame and the target luminance gain of a present frame, and a backlight luminance calculator outputting the backlight control signal based on the output luminance gain to control the light output from the backlight unit.

The backlight luminance calculator outputs the backlight control signal to allow the backlight unit to output the light having a luminance in proportion to the output luminance gain.

The display device further includes a still image determination unit determining whether the first image signal is the still image and outputting a still image flag signal.

The display device further includes an average luminance calculator calculating the average luminance of the first image signal. The target luminance gain calculator calculates the target luminance gain based on the average luminance when the still image flag signal has a first level.

According to the above, the display device changes the luminance of the image signal gradually when the display image is determined to be a still image. Image burn-in and deteriorating of the display device may be reduced, while the user's perception with respect to the change of the luminance of the display image is reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION OF THE EMBODIMENTS

Hereinafter, exemplary embodiments of the present disclosure will be explained in detail with reference to the accompanying drawings.

Figure 1:
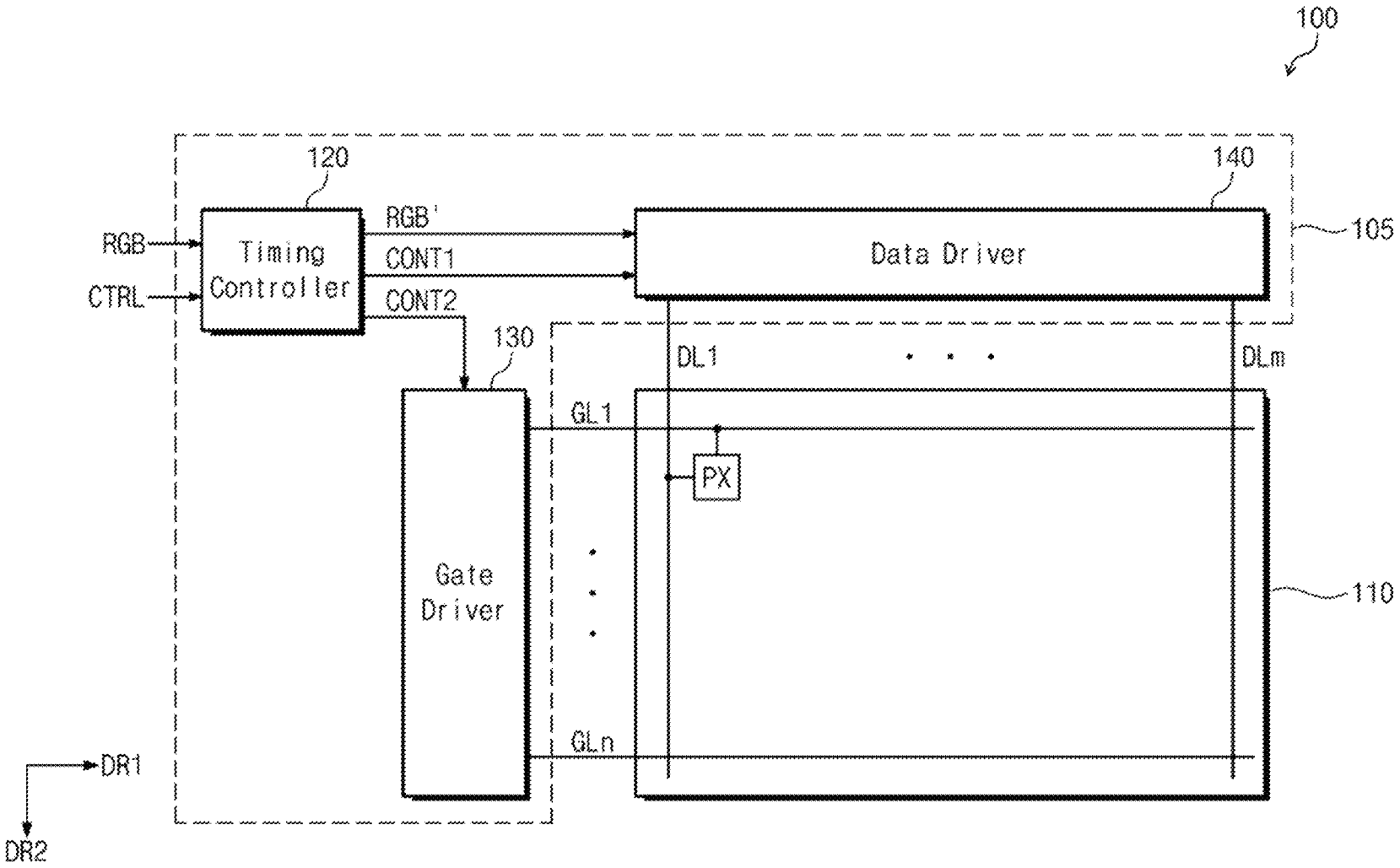
FIG. 1 is a block diagram showing a display device according to an exemplary embodiment of the present disclosure.

FIG. 1 is a block diagram showing a display device 100 according to an exemplary embodiment of the present disclosure.

Referring to FIG. 1, the display device 100 includes a display panel 110 and a driving circuit 105.

The display panel 110 may be one of various display panels, such as a liquid crystal display panel, an organic light emitting display panel, an electrophoretic display panel, an electrowetting display panel, etc. In a case that the liquid crystal display is employed as the display panel 110, the display device 100 further includes a backlight unit to supply a light to the display panel 110.

The display panel 110 includes a plurality of gate lines GL1 to GLn extending in a first direction DR1, a plurality of data lines DL1 to DLm extending in a second direction DR2, and a plurality of pixels PX arranged in areas defined by the gate lines GL1 to GLn and the data lines DL1 to DLm that crosses the gate lines GL1 to GLn. The data lines DL1 to DLm are insulated from the gate lines GL1 to GLn while crossing the gate lines GL1 to GLn. Each of the pixels is connected to a corresponding gate line of the gate lines GL1 to GLn and a corresponding data line of the data lines DL1 to DLm.

The driving circuit 105 receives an input image signal RGB and provides data signals corresponding to an output image signal RGB' to the pixels PX through the data lines DL1 to DLm of the display panel 110 to display an image through the pixels PX.

The driving circuit 105 includes a timing controller 120, a gate driver 130, and a data driver 140. The timing controller 120 receives the input image signal RGB and controls signals CTRL from an external source (not shown). The control signals CTRL include, for example, a vertical synchronization signal, a horizontal synchronization signal, a main clock signal, a data enable signal, etc. The timing controller 120 applies the output image signal RGB' and a first control signal CONT1 to the data driver 140. The timing controller 120 applies a second control signal CONT2 to the gate driver 130. The output image signal RGB' is obtained by processing the input image signal RGB by taking into account an operating condition of the display panel 110 based on the control signals CTRL. The first control signal CONT1 includes a horizontal synchronization start signal, a clock signal, and a line latch signal. The second control signal CONT2 includes a vertical synchronization start signal, an output enable signal, and a gate pulse signal. The timing controller 120 may convert and output the output image signal RGB' in various ways depending on the alignment of the pixels PX and a display frequency of the display panel 110.

The gate driver 130 drives the gate lines GL1 to GLn in response to the second control signal CONT2 from the timing controller 120. The gate driver 130 includes a gate driving integrated circuit. In some embodiments, the gate driver 130 may be implemented in a circuit with an oxide semiconductor, an amorphous semiconductor, a crystalline semiconductor, a polycrystalline semiconductor, or the like. The gate driver 130 may be formed in a predetermined area of the display panel 110; in this case, the gate driver 130 may be substantially simultaneously formed with the pixels PX through a thin film process.

The data driver 140 drives the data lines DL1 to DLm in response to the output image signal RGB' and the first control signal CONT1 received from the timing controller 120.

Figure 2:
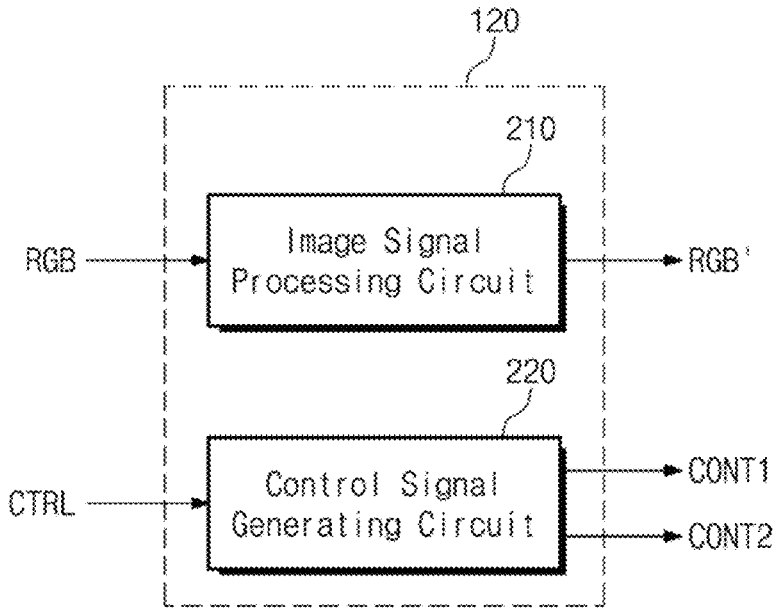
FIG. 2 is a block diagram showing a timing controller according to an exemplary embodiment of the present disclosure.

FIG. 2 is a block diagram showing the timing controller 120 according to an exemplary embodiment of the present disclosure.

Referring to FIG. 2, the timing controller 120 includes an image signal processing circuit 210 and a control signal generating circuit 220.

The image signal processing circuit 210 outputs the output image signal RGB' based on the input image signal RGB provided from the external source (not shown). The control signal generating circuit 220 outputs the first control signal CONT1 and the second control signal CONT2 based on the control signals CTRL provided from the external source (not shown). The first control signal CONT1 includes the horizontal synchronization start signal, the clock signal, and the line latch signal. The second control signal CONT2 includes the vertical synchronization start signal, the output enable signal, and the gate pulse signal.

When the display panel 110 is an organic light emitting display panel, the quality of the images displayed on the display panel 110 may be influenced by the deterioration of the organic light emitting diodes and/or the thin film transistors in the display panel 110. For example, when an OLED display devices displays a still image (e.g., an image without motion, which is also known as a freeze image) for a long time, the organic light emitting diodes and/or the thin film transistors in some of the pixels may experience higher stress than those in other pixels. As a result, the stressed organic light emitting diodes and/or the thin film transistors may get deteriorated faster than others and may have noticeably different electrical properties and/or optical properties. One consequence of such uneven change among different pixels is that a DC afterimage (in the form of a stress pattern similar to a still image) may appear in the display panel. The stress caused by the still image may reduce a display quality and a lifespan of the OLED display device. In some exemplary embodiments of the present disclosure, the driving circuit 105 can be implemented to gradually decrease a luminance of the display image while the input image signal RGB is determined to be a still image.

In one exemplary embodiment as shown in FIG. 2, the image signal processing circuit 210 outputs the output image signal RGB' that is modified from the input image signal RGB when the input image signal RGB is determined to be a still image. In particular, the image signal processing circuit 210 changes the luminance of the output image signal RGB' such that the luminance of the image displayed through the display panel 110 (refer to FIG. 1) gradually decreases while the input image signal RGB is determined to be a still image, which minimizes a user's perception on luminance changes in the displayed images. Additionally, the image signal processing circuit 210 changes the luminance of the output image signal RGB' such that the luminance of the image displayed through the display panel 110 (refer to FIG. 1) gradually increases when the input image signal RGB is determined to be changed to a moving image from the still image, which also minimizes the user's perception on the luminance changes in the displayed images.

Figure 3:
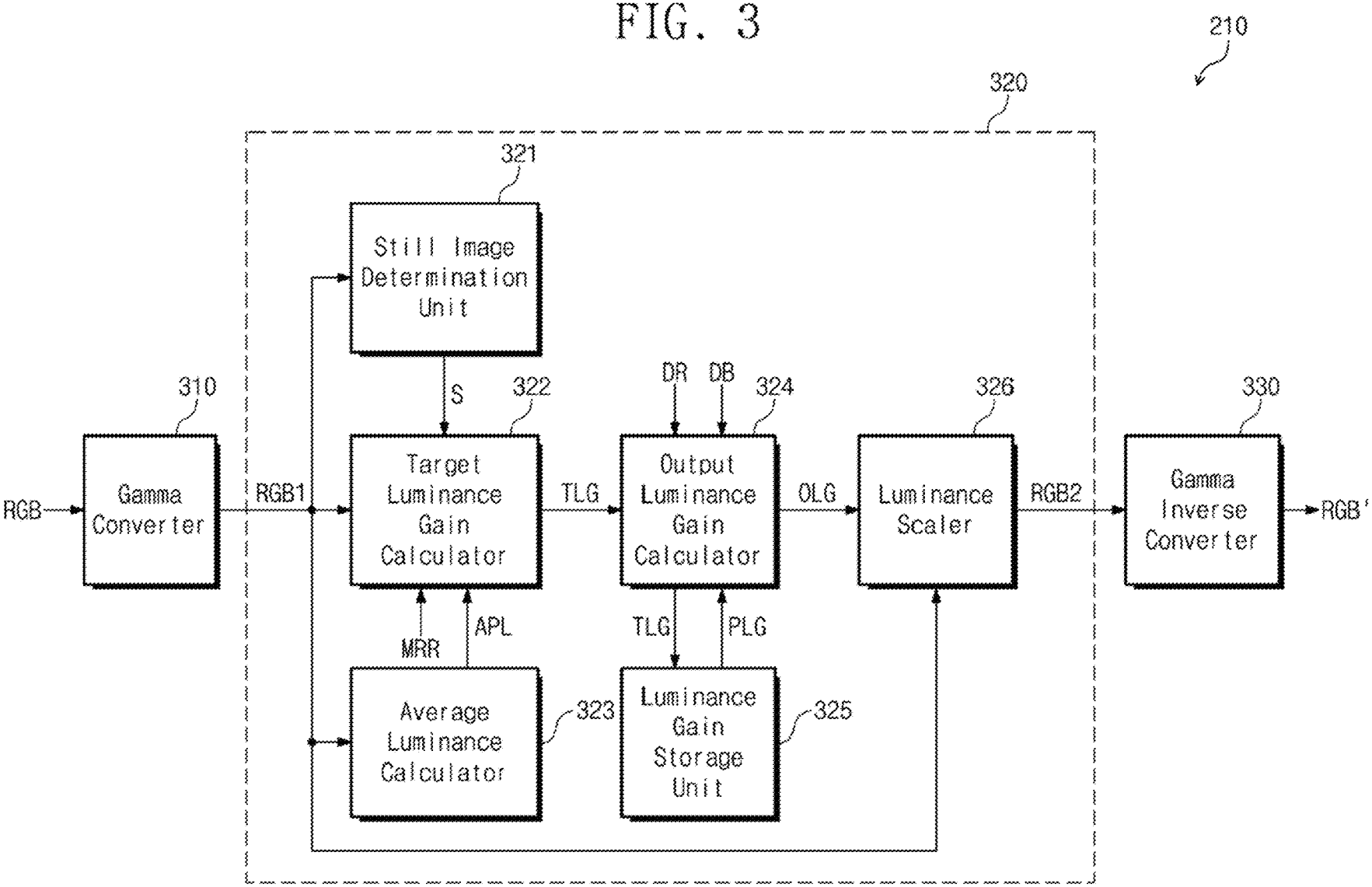
FIG. 3 is a block diagram showing an image signal processing circuit according to an exemplary embodiment of the present disclosure.

FIG. 3 is a block diagram showing the image signal processing circuit 210 according to an exemplary embodiment of the present disclosure.

Referring to FIG. 3, the image signal processing circuit 210 includes a gamma converter 310, a luminance control circuit 320, and a gamma inverse converter 330.

The input image signal RGB includes red grayscale data, green grayscale data, and blue grayscale data. The gamma converter 310 linearizes the input image signal RGB having non-linear characteristics and outputs a first image signal RGB1. In some embodiments, the gamma converter 310 linearizes the input image signal RGB based on a gamma look-up table (not shown) to output the first image signal RGB1. The gamma look-up table can be implemented to store luminance data that depends on a reference gamma value. As an example, the reference gamma value may be about 2.2.

The luminance control circuit 320 outputs a second image signal RGB2 obtained by controlling a luminance of the first image signal RGB1 when the first image signal RGB1 is determined to be a still image. The luminance control circuit 320 includes a target luminance gain calculator 322, an output luminance gain calculator 324, and a luminance scaler 326. The target luminance gain calculator 322 is implemented to calculate a target luminance gain TLG based on an average luminance of the first image signal RGB1 when the first image signal RGB1 is determined to be a still image. The output luminance gain calculator 324 is implemented to calculate an output luminance gain OLG based on a previous output luminance gain PLG of a previous frame and a target luminance gain TLG of a present frame. The luminance scaler 326 is implemented to output the second image signal RGB2 obtained by changing the luminance of the first image signal RGB1 based on the output luminance gain OLG.

The luminance control circuit 320 further includes a still image determination unit 321, an average luminance calculation unit 323, and a luminance gain storage unit 325.

The still image determination unit 321 is implemented to determine whether the first image signal RGB1 is a still image and to output a still image flag signal S accordingly. In one embodiment, the still image determination unit 321 compares the first image signal RGB1 of the previous frame with the first image signal RGB1 of the present frame and determines that the first image signal RGB1 of the present frame is a still image when a difference between the first image signal RGB1 of the previous frame and the first image signal RGB1 of the present frame is equal to or smaller than a predetermined value. According to another embodiment, the still image determination unit 321 compares a portion of the first image signal RGB1 of the previous frame with the same portion of the first image signal RGB1 of the present frame (which correspond to a predetermined area of the display panel 110 as shown in FIG. 1) to determine whether the first image signal RGB1 of the present frame is a still image. In still another embodiment, the still image determination unit 321 compares the amount of changes of a portion of the first image signal RGB1 between each two sequential frames with a predetermined value; if the amount of changes of this portion of the first image signal RGB1 is consistently equal to or smaller than the predetermined value for a predetermined number of frames consecutively (e.g., three frames, four frames, . . . , or other selected integer number of frames), the still image determination unit 321 determines that the first image signal RGB1 of the present frame is a still image.

When it is determined that the first image signal RGB1 of the present frame is a still image, the still image determination unit 321 outputs the still image flag signal S at a first level (e.g., a high level).

The average luminance calculation unit 323 receives the first image signal RGB1 and calculates an average luminance APL of one frame. The average luminance APL of one frame may be calculated by the following Equation 1.

$$APL = \frac{\sum (0.2 \cdot R - 0.7 \cdot G - 0.1 \cdot B)}{N} \quad \text{Equation 1}$$

In Equation 1, one first image signal RGB1 includes a red signal, a green signal, and a blue signal, and R, G, and B respectively correspond to the red signal, the green signal, and the blue signal of the first image signal RGB1. "N" denotes the number of the first image signals RGB1 included in one frame.

The average luminance APL calculated by the average luminance calculation unit 323 is provided to the target luminance gain calculator 322.

The target luminance gain calculator 322 calculates the target luminance gain TLG that is used to determine the amount of reduction on the luminance of the first image signal RGB1 based on the average luminance APL when the still image flag signal S from the still image determination unit 321 is at the first level. As the average luminance APL becomes higher (i.e., as the luminance of the display image becomes higher), the thin film transistors in the display panel 110 may be subjected to higher level of stress. Accordingly, the target luminance gain calculator 322 is implemented to calculate the target luminance gain TLG such that the amount of luminance reduction increases as the average luminance APL becomes higher.

The target luminance gain TLG calculated by the target luminance gain calculator 322 may be obtained by the following Equation 2.

$$TLG = MRR + (1 - APL) * MRR \quad \text{Equation 2}$$

In Equation 2, "MRR" denotes a luminance reduction coefficient provided from the external source (not shown) (or stored in a memory (not shown) of the luminance control circuit 320. "APL" denotes the average luminance calculated by the average luminance calculation unit 323.

In a first example, when the luminance reduction coefficient MRR is about 0.5 and the average luminance APL is about 1 (e.g., the highest grayscale), the target luminance gain TLG is about 0.5. In a second example, when the luminance reduction coefficient MRR is about 0.5 and the average luminance APL is about 0.5 (e.g., an intermediate grayscale), the target luminance gain TLG is about 0.75. As demonstrated by the results of the target luminance gain TLG in the above two examples, when the average luminance APL increases from 0.5 to 1.0, the target luminance gain TLG decreases from 0.75 to 0.5, which represents an increase in the amount of luminance reduction.

The output luminance gain calculator 324 calculates the output luminance gain OLG based on a previous output luminance gain PLG of the previous frame and the target luminance gain TLG of the present frame.

The luminance gain storage unit 325 stores the target luminance gain TLG of the present frame and provides the previous output luminance gain PLG of the previous frame to the output luminance gain calculator 324.

In the previously described examples, when the luminance reduction coefficient MRR is about 0.5 and the average luminance APL is about 1, the target luminance gain TLG obtained by the target luminance gain calculator 322 is about 0.5. In this example, the luminance of the image displayed through the display panel 110 can be reduced by up to about 50% of the luminance of the first image signal RGB1.

When the luminance of the still image is rapidly changed while the still image is displayed through the display panel 110, the user may perceive a sudden change of the luminance. Accordingly, to prevent such sudden change of the luminance, the output luminance gain calculator 324 calculates the output luminance gain OLG by taking into account not only the target luminance gain TLG of the present frame but also the previous output luminance gain PLG of the previous frame.

The output luminance gain calculator 324 calculates the output luminance gain OLG by the following Equation 3.

$$DW = |(PLG - TLG)| * DR + DB$$

$$OLG = DW * TLG - (1 - DW) * PLG \quad \text{Equation 3}$$

In Equation 3, "DW" denotes a decay weight, "DR" denotes a decay rate, and "DB" denotes a decay bias.

The decay rate DR and the decay bias DB may be values provided from the external source (not shown) or stored in the memory (not shown) of the luminance control circuit 320.

As represented by Equation 3, the output luminance gain OLG is determined based on the decay weight DW, the target luminance gain TLG of the present frame, and the previous output luminance gain PLG of the previous frame.

The luminance scaler 326 outputs the second image signal RGB2 obtained by changing the luminance of the first image signal RGB1 based on the output luminance gain OLG The luminance scaler 326 calculates the second image signal RGB2 by the following Equation 4.

$$RGB2 = RGB1 * OLG \quad \text{Equation 4}$$

Accordingly, when the first image signal RGB1 is determined to be a still image, the luminance control circuit 320 may output the second image signal RGB2 that has luminance decreasing gradually over several frames.

The gamma inverse converter 330 non-linearizes the second image signal RGB2 based on an output gamma look-up table (not shown) calculated using an inverse gamma function of the gamma look-up table (not shown) to output the output image signal RGB'. As an example, in a case that the gamma look-up table of the gamma converter 310 is formed by the gamma function having the gamma value of about 2.2, the output gamma look-up table of the gamma inverse converter 330 may be formed by the inverse gamma function corresponding to the gamma value of about 2.2. The output gamma look-up table may store grayscale data calculated by the inverse gamma function of the gamma look-up table.

Figure 4:
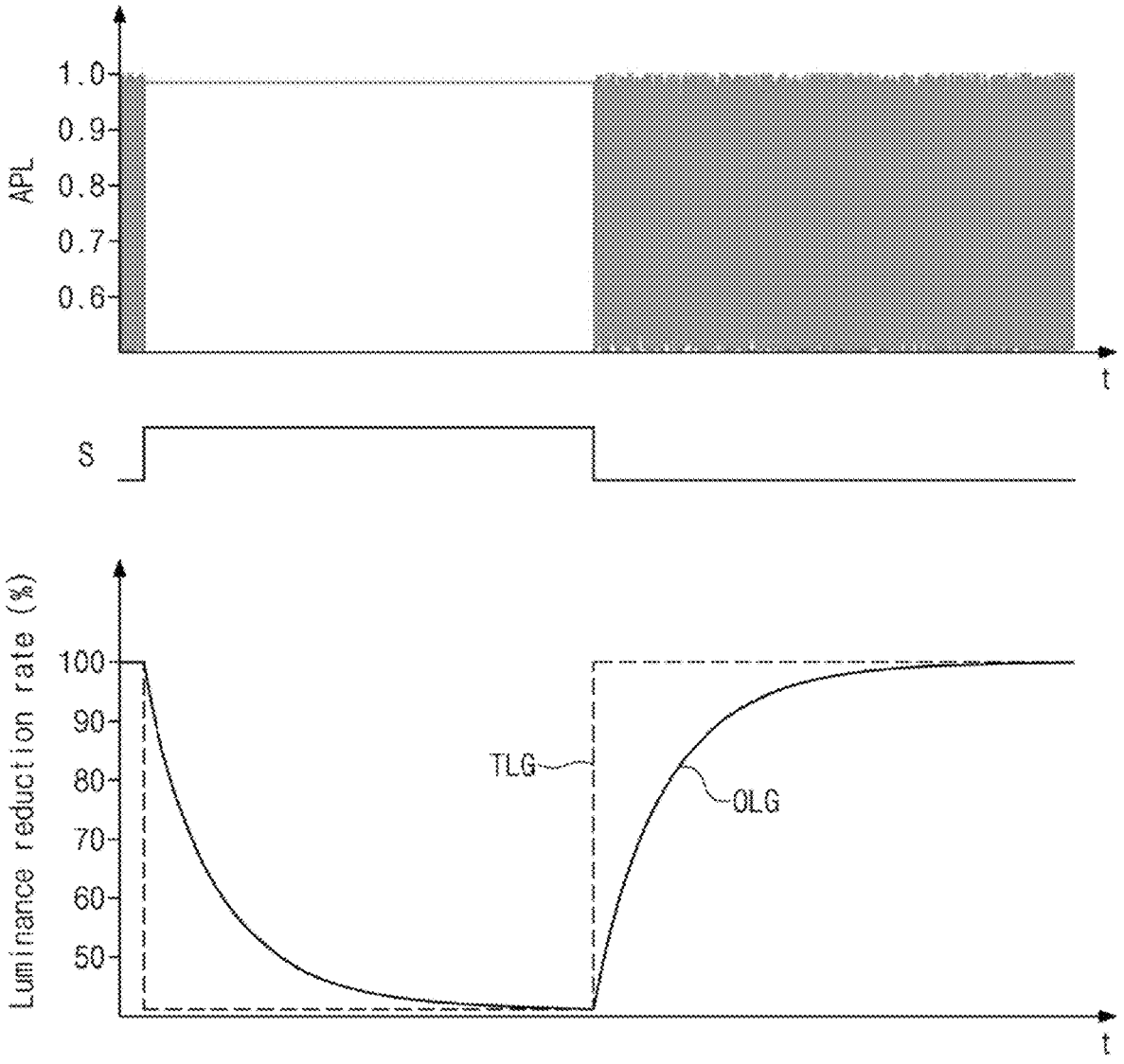
FIGS. 4 and 5 are views showing a target luminance gain as a function of an average luminance and an output luminance gain as a function of the average luminance.
Figure 5:
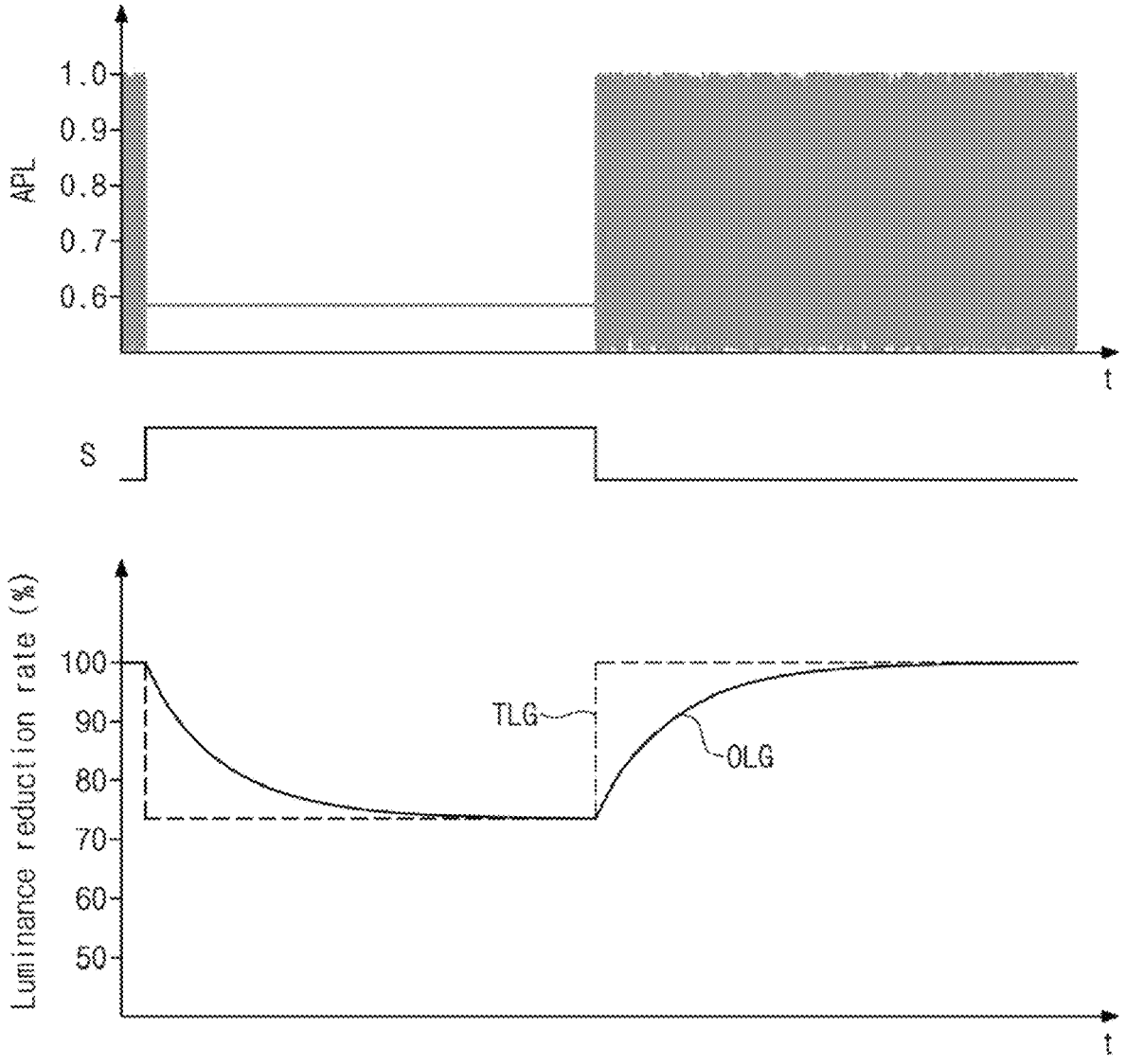

FIGS. 4 and 5 are views showing each of the target luminance gain and the output luminance gain as a function of time which is influenced by the change of the average luminance as a function of time.

Referring to FIGS. 3 to 5, the target luminance gain calculator 322 outputs the target luminance gain TLG, which becomes lower as the average luminance APL from the average luminance calculation unit 323 increases, while the still image flag signal S has the first level (e.g., the high level).

The output luminance gain calculator 324 calculates the output luminance gain OLG by taking into account not only the target luminance gain TLG of the present frame but also the previous output luminance gain PLG of the previous frame. Accordingly, the output luminance gain calculator 324 outputs the output luminance gain OLG such that the luminance of the second image signal RGB2 gradually changes (e.g., in a decay shape) from the luminance of the first image signal RGB1 to the luminance corresponding to the target luminance gain TLG.

When the still image flag signal S is transited to the second level (e.g., the low level) from the first level (e.g., the high level), the target luminance gain calculator 322 outputs "1" as the target luminance gain TLG. Since the change in the target luminance gain TLG is large when the first image signal RGB1 has changed from a still image to a moving image, the output luminance gain calculator 324 is implemented to gradually change the output luminance gain OLG Since the output luminance gain calculator 324 calculates the output luminance gain OLG by taking into account not only the target luminance gain TLG of the present frame but also the previous output luminance gain PLG of the previous frame, the luminance of the image displayed through the display panel 110 may be prevented from being rapidly changed even though the first image signal RGB1 has changed from a still image to a moving image.

Figure 6:
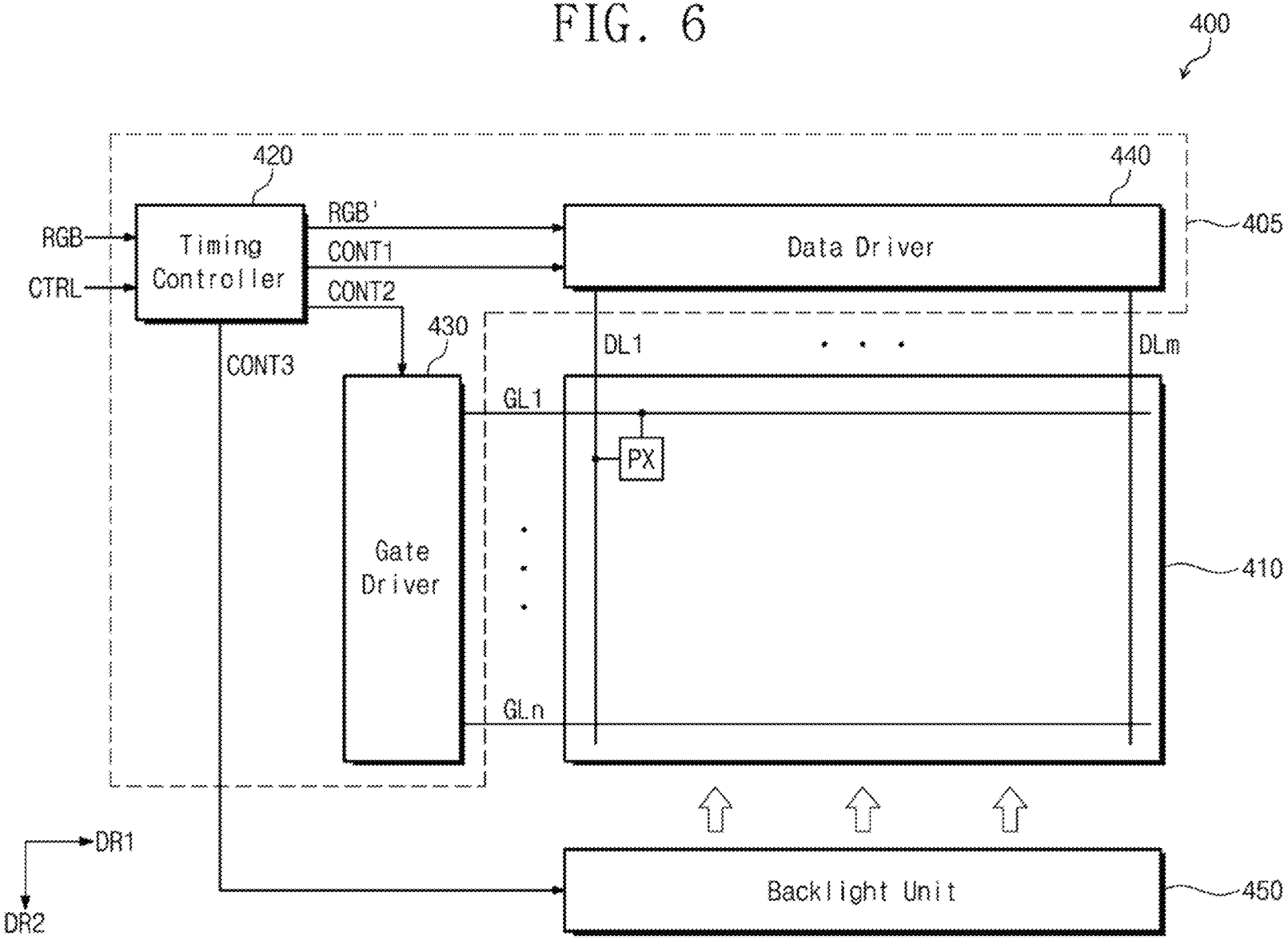
FIG. 6 is a block diagram showing a display device according to another exemplary embodiment of the present disclosure.

FIG. 6 is a block diagram showing a display device 400 according to another exemplary embodiment of the present disclosure.

Referring to FIG. 6, the display device 400 includes a display panel 410, a driving circuit 405, and a backlight unit 450. The display panel 410 and the driving circuit 405 of the display device 400 shown in FIG. 6 have substantially the same configuration and function as those of the display panel 110 and the driving circuit 105 shown in FIG. 1, and thus details thereof will be omitted.

A timing controller 420 of the driving circuit 405 applies a backlight control signal CONT3 to the backlight unit 450 to control the backlight unit 450. The backlight unit 450 supplies a light to the display panel 410 in response to the backlight control signal CONT3.

In some embodiments, when an input image signal RGB is determined to be a still image, the timing controller 420 outputs the backlight control signal CONT3 that gradually decreases a luminance of the light output from the backlight unit 450. Accordingly, the luminance of the display image decreases while the still image is displayed through the display panel 410, and thus power consumption may be reduced.

Figure 7:
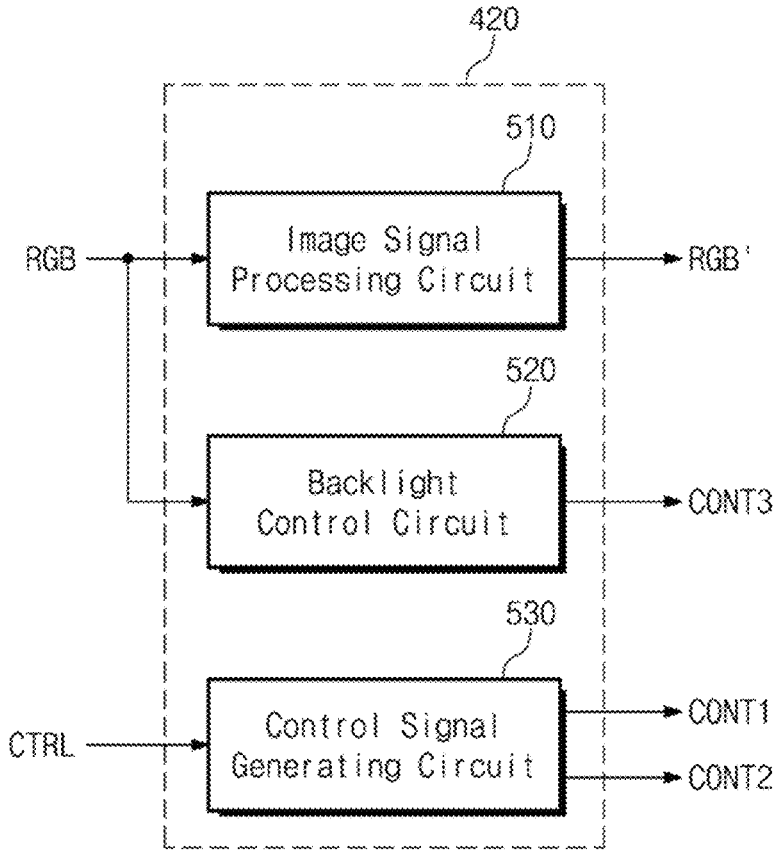
FIG. 7 is a block diagram showing a timing controller according to another exemplary embodiment of the present disclosure.

FIG. 7 is a block diagram showing the timing controller 420 according to another exemplary embodiment of the present disclosure.

Referring to FIG. 7, the timing controller 420 includes an image signal processing circuit 510, a backlight control circuit 520, and a control signal generating circuit 530.

The image signal processing circuit 510 converts the input image signal RGB from an external source (not shown) to an output image signal RGB' appropriate to the display panel 410 (refer to FIG. 6) and outputs the output image signal RGB'.

The backlight control circuit 520 outputs the backlight control signal CONT3 to gradually decrease (becomes darker) the luminance of the light provided from the backlight unit 450 when the input image signal RGB from the external source is determined to be a still image. The backlight control circuit 520 outputs the backlight control signal CONT3 to the backlight unit 450 to make the luminance of the light provided from the backlight unit 450 gradually increase (becomes brighter) when the input image signal RGB is changed to the video image from the still image.

The control signal generating circuit 530 outputs a first control signal CONT1 and a second control signal CONT2 based on control signals CTRL provided from the external source.

Figure 8:
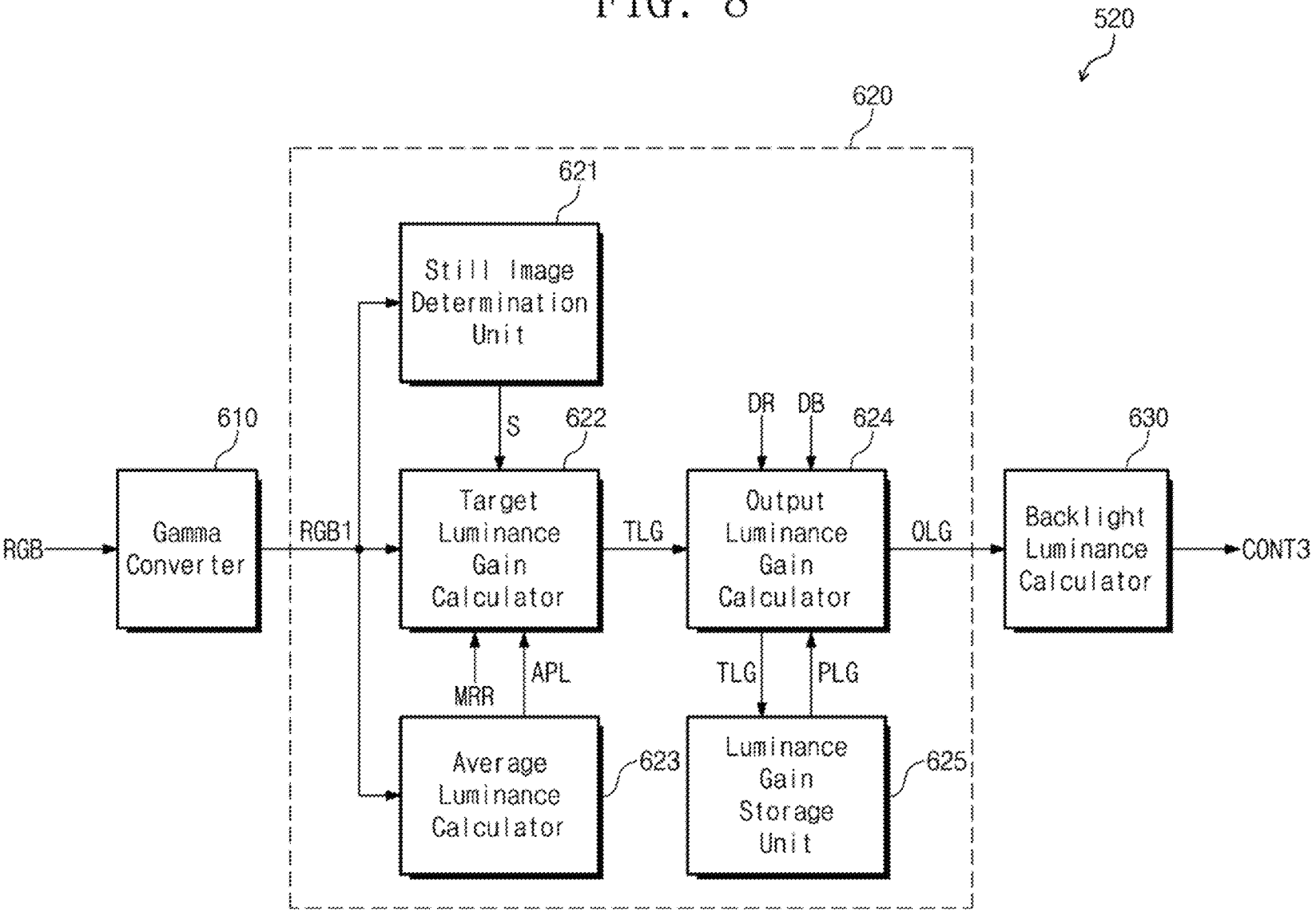
FIG. 8 is a block diagram showing a backlight control circuit according to another exemplary embodiment of the present disclosure.

FIG. 8 is a block diagram showing a backlight control circuit 520 according to another exemplary embodiment of the present disclosure.

Referring to FIG. 8, the backlight control circuit 520 includes a gamma converter 610, a luminance control circuit 620, and a backlight control calculator 630.

The gamma converter 610 linearizes the input image signal RGB based on a gamma look-up table (not shown) to output a first image signal RGB1.

The luminance control circuit 620 outputs an output luminance gain OLG used to control the luminance of the backlight unit 450 (refer to FIG. 6) when the first image signal RGB1 is determined to be a still image. The luminance control circuit 620 includes a target luminance gain calculator 622 and an output luminance gain calculator 624. The target luminance gain calculator 622 calculates a target luminance gain TLG based on an average luminance of the first image signal RGB1 when the first image signal RGB1 is determined to be a still image. The output luminance gain calculator 624 calculates the output luminance gain OLG based on a previous output luminance gain PLG of a previous frame and the target luminance gain TLG of a present frame.

The luminance control circuit 620 further includes a still image determination unit 621, an average luminance calculation unit 623, and a luminance gain storage unit 625.

The still image determination unit 621 determines whether the first image signal RGB1 is a still image and outputs a still image flag signal S accordingly. In one embodiment, the still image determination unit 621 compares the first image signal RGB1 of the previous frame with the first image signal RGB1 of the present frame and determines that the first image signal RGB1 of the present frame is a still image when a difference between the first image signal RGB1 of the previous frame and the first image signal RGB1 of the present frame is equal to or smaller than a predetermined value. According to another embodiment, the still image determination unit 621 compares a portion of the first image signal RGB1 of the previous frame with a portion of the first image signal RGB1 of the present frame (which correspond to a predetermined area of the display panel 410 as shown in FIG. 6) to determine whether the first image signal RGB1 of the present frame is a still image. When it is determined that the first image signal RGB1 of the present frame is a still image, the still image determination unit 621 outputs the still image flag signal S at the first level (e.g., the high level).

The average luminance calculation unit 623 receives the first image signal RGB1 and calculates the average luminance APL of one frame. The average luminance APL of one frame may be calculated by the above-mentioned Equation 1.

The average luminance APL calculated by the average luminance calculation unit 623 is applied to the target luminance gain calculator 622.

The target luminance gain calculator 622 calculates the target luminance gain TLG based on the average luminance APL when the still image flag signal S from the still image determination unit 621 has the first level. As the average luminance APL becomes higher (i.e., as the luminance of the display image becomes higher), the power consumption in the display device 400 increases. Accordingly, the target luminance gain calculator 622 is implemented to calculate the target luminance gain TLG such that an amount of luminance reduction increases as the average luminance APL becomes higher.

The target luminance gain TLG calculated by the target luminance gain calculator 622 may be obtained by the above-described Equation 2.

The output luminance gain calculator 624 calculates the output luminance gain OLG based on the previous output luminance gain PLG of the previous frame and the target luminance gain TLG of the present frame.

The luminance gain storage unit 625 stores the target luminance gain TLG of the present frame and provides the previous output luminance gain PLG of the previous frame to the output luminance gain calculator 624.

When the luminance of the still image is rapidly changed while the still image is displayed through the display panel 410, the user may perceive a sudden change of the luminance. Accordingly, to prevent such sudden change of the luminance, the output luminance gain calculator 624 calculates the output luminance gain OLG by taking into account not only the target luminance gain TLG of the present frame but also the previous output luminance gain PLG of the previous frame.

The output luminance gain calculator 624 calculates the output luminance gain OLG using the above-described Equation 3.

The backlight luminance calculator 630 outputs the backlight control signal CONT3 based on the output luminance gain OLG to control the luminance of the backlight unit 450.

Accordingly, when the first image signal RGB1 is determined to be a still image, the backlight luminance calculator 630 outputs the backlight control signal CONT3 such that the luminance of the light generated by the backlight unit 450 gradually decreases over several frames.

Additionally, when the first image signal RGB1 is determined to be changed to a moving image from a still image, the backlight control circuit 520 outputs the backlight control signal CONT3 such that the luminance of the light generated by the backlight unit 450 gradually increases, to minimize the user's perception on the luminance change in the displayed images.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A luminance control circuit comprising:

a target luminance gain calculator configured to calculate a target luminance gain when the a first image signal is determined to be a still image;

an output luminance gain calculator configured to calculate an output luminance gain based on a previous output luminance gain of a previous frame and the target luminance gain of a present frame; and a luminance scaler configured to output a second image signal obtained by changing a luminance of the first image signal based on the output luminance gain, wherein the target luminance gain is obtained based on a luminance reduction coefficient and an average luminance of the first image signal, and the luminance reduction coefficient is less than or equal to 1; and wherein the target luminance gain (TLG) is obtained based on equation TLG=MRR+(1−APL)×MRR, wherein the "APL" denotes the average luminance and the "MRR" denotes the luminance reduction coefficient and wherein the "MRR" and the "APL" satisfy respectively the relations of MRR≤1 and APL≤1.

2. The luminance control circuit of claim 1, wherein the target luminance gain calculator outputs the target luminance gain that linearly depends upon the average luminance.

3. The luminance control circuit of claim 1, further comprising:

a still image determination unit configured to determine whether the first image signal is a still image by comparing the first image signal of a previous frame with the first image signal of a present frame and when a difference between the first image signal of the previous frame and the first image signal of the present frame is equal to or smaller than a predetermined value.

4. The luminance control circuit of claim 3, further comprising:

an average luminance calculator configured to calculate the average luminance of the first image signal when a still image flag signal is transited to a second level from a first level and maintains the target luminance gain while the still image flag signal is maintained at the second level.

5. The luminance control circuit of claim 1, further comprising a luminance gain storage unit to store the previous output luminance gain.

6. The luminance control circuit of claim 1, wherein the output luminance gain (OLG) is obtained based on equation OLG=decay weight (DW)×TLG−(1−DW)×PLG, and the decay weight (DW) is obtained based on equation DW=|PLG−TLG|×DR+DB, wherein the "PLG" denotes the previous output luminance gain, the "TLG" denotes the target luminance gain, the "DR" denotes a decay rate, and the "DB" denotes a decay bias, and wherein the "PLG", the "TLG", the "DR", and the "DB" satisfy respectively the relations of PLG≤1, TLG≤1, DR<1, and DB<1.

7. The luminance control circuit of claim 6, wherein the second image signal (RGB2) is obtained based on equation RGB2=RGB1×OLG, and wherein the "RGB1" denotes the first image signal.

8. The luminance control circuit of claim 1, wherein the target luminance gain calculator calculates the target luminance gain based on the average luminance of the first image signal when the first image signal is determined to be the still image.

9. A display device comprising:

a display panel comprising a plurality of pixels; and a driving circuit configured to receive an input image signal, providing a data signal corresponding to an output image signal to the pixels, and controlling the pixels to display an image, the driving circuit comprising an image signal processing circuit converting the input image signal to the output image signal, the image signal processing circuit comprising:

a gamma converter configured to convert the input image signal to a first image signal;

a target luminance gain calculator configured to calculate a target luminance gain when the first image signal is determined to be a still image;

an output luminance gain calculator configured to calculate an output luminance gain based on a previous output luminance gain of a previous frame and the target luminance gain of a present frame;

a luminance scaler configured to output a second image signal obtained by changing a luminance of the first image signal based on the output luminance gain; and a gamma inverse converter configured to convert the second image signal to the output image signal, wherein the target luminance gain is obtained based on a luminance reduction coefficient and an average luminance of the first image signal, and the luminance reduction coefficient is less than or equal to 1; and wherein the target luminance gain (TLG) is obtained based on equation TLG=MRR+(1−APL)×MRR, wherein the "APL" denotes the average luminance and the "MRR" denotes the luminance reduction coefficient, and wherein the "MRR" and the "APL" satisfy respectively the relations of MRR≤1 and APL≤1.

10. The display device of claim 9, wherein the target luminance gain calculator outputs the target luminance gain that linearly depends upon the average luminance.

11. The display device of claim 9, further comprising:

an average luminance calculator configured to calculate the average luminance of the first image signal; and wherein the average luminance is calculated when a still image flag signal has a first level.

12. The display device of claim 9, further comprising a luminance gain storage unit to store the previous output luminance gain.

13. The display device of claim 9, wherein the second image signal (RGB2) is obtained by based on the equation RGB2=RGB1×OLG, and wherein the "RGB1" denotes the first image signal and the "OLG" denotes the output luminance gain.

14. A display device comprising:

a display panel comprising a plurality of pixels;

a backlight unit configured to supply a light to the display panel in response to a backlight control signal; and a driving circuit configured to receive an input image signal, provide a data signal corresponding to an output image signal to the pixels to display an image through the pixels, and output the backlight control signal in response to the input image signal, the driving circuit comprising a backlight control circuit outputting the backlight control signal to control the light output from the backlight unit, the backlight control circuit comprising:

a gamma converter configured to convert the input image signal to a first image signal;

a target luminance gain calculator configured to calculate a target luminance gain when the first image signal is determined to be a still image;

an output luminance gain calculator configured to calculate an output luminance gain based on a previous output luminance gain of a previous frame and the target luminance gain of a present frame; and a backlight luminance calculator configured to output the backlight control signal based on the output luminance gain to control the light output from the backlight unit, wherein the target luminance gain is obtained based on a luminance reduction coefficient and an average luminance of the first image signal, and the luminance reduction coefficient is less than or equal to 1; and wherein the target luminance gain (TLG) is obtained based on equation TLG=MRR+(1−APL)×MRR, wherein the "APL" denotes the average luminance and the "MRR" denotes the luminance reduction coefficient, and wherein the "MRR" and the "APL" satisfy respectively the relations of MRR≤1 and APL≤1.

15. The display device of claim 14, wherein the backlight luminance calculator outputs the backlight control signal to allow the backlight unit to output the light having a luminance that linearly depends upon the output luminance gain.

16. The display device of claim 14, further comprising:

an average luminance calculator configured to calculate the average luminance of the first image signal; and wherein the average luminance is calculated when a still image flag signal has a first level.

* * * * *